US007980303B2

(12) United States Patent
Hill, Jr. et al.

(10) Patent No.: US 7,980,303 B2
(45) Date of Patent: Jul. 19, 2011

(54) LAMINATE PRESSURE CONTAINING BODY FOR A WELL TOOL

(75) Inventors: Thomas G. Hill, Jr., Conroe, TX (US); Cecil G. McGavern, III, The Woodlands, TX (US); Winfield M. Sides, III, Bellaire, TX (US); Jason Mailand, The Woodlands, TX (US)

(73) Assignee: Tejas Associates, Inc.

( * ) Notice: Subject to any disclaimer, the term of this patent is extended or adjusted under 35 U.S.C. 154(b) by 0 days.

(21) Appl. No.: 12/572,653

(22) Filed: Oct. 2, 2009

(65) Prior Publication Data

US 2010/0018700 A1 Jan. 28, 2010

Related U.S. Application Data

(63) Continuation of application No. 11/501,414, filed on Aug. 9, 2006, now abandoned.

(51) Int. Cl.
*E21B 17/00* (2006.01)

(52) U.S. Cl. ..... 166/242.1; 138/153

(58) Field of Classification Search ..... 166/241.6, 166/242.1, 242.4; 138/140, 153, 172, 176
See application file for complete search history.

(56) References Cited

U.S. PATENT DOCUMENTS

| | | | | |
|---|---|---|---|---|
| 1,959,367 | A * | 5/1934 | Kennedye | 166/241.6 |
| 2,592,854 | A * | 4/1952 | Boice | 175/325.2 |
| 3,220,437 | A * | 11/1965 | Safford | 138/148 |
| 5,988,300 | A * | 11/1999 | Pomerleau et al. | 175/320 |
| 2005/0173121 | A1* | 8/2005 | Steele et al. | 166/313 |
| 2006/0124308 | A1* | 6/2006 | Davis | 166/305.1 |
| 2008/0115931 | A1* | 5/2008 | Shuster | 166/250.01 |

* cited by examiner

*Primary Examiner* — Daniel P Stephenson
(74) *Attorney, Agent, or Firm* — Claude E. Cooke, Jr.; John J. Love; Cooke Law Firm

(57) ABSTRACT

Apparatus if provided for use in wells, particularly wells that have high-pressure and high-temperature conditions in the well. The shells of completion equipment that is required to withstand the rigorous conditions in such wells are increased in strength by laminate layers that are formed of materials having higher yield strength than the yield strength of materials that can be used in well fluids.

13 Claims, 3 Drawing Sheets

LAMINATE PRESSURE CONTAINING BODY FOR A WELL TOOL

This is a continuation of application Ser. No. 11/501,414 filed Aug. 8, 2006.

BACKGROUND OF THE INVENTION

1. Field of the Invention

This invention pertains to apparatus for use in wells. More particularly, pressure-containing apparatus is provided for use in high-pressure, high-temperature wells where wall thickness of apparatus is to be minimized and material selection is limited by well conditions.

2. Description of Related Art

With energy prices at all time highs, companies involved in the discovery and production of hydrocarbons are pursuing deeper offshore oil and gas plays. As well depths increase, well architecture becomes more challenging. Geologists, geophysicists and petroleum engineers understand that as well depths increase, so does formation pressure and temperature. It is estimated that pressures of 30,000 psi and 500 deg F. and beyond may become commonplace in future wells. The industry acronym for High-Pressure and High-Temperature wells is HPHT. As HPHT conditions present themselves in deep wells, the equipment needed to safely complete and produce HPHT wells must be developed to withstand safely the rigors of these extreme conditions.

Industry is developing methods and materials to drill the HPHT wells safely, but technology gaps in equipment placed in the wells for producing the wells, called "well completion equipment," also must be addressed. This includes, but is not limited to devices that are normally larger diameter than the tubing, such as subsurface safety valves, packers, flow control devices (e.g., sliding sleeves), tubing hangers, on-off attachments, and gas lift or instrument mandrels as well as equipment normally the same diameter as tubulars that would preferably be smaller in diameter, as least in some segments of a well, such as production tubing, liners, expansion joints and their connectors. Several papers have been published recently addressing and discussing "gaps" in current technology (for examples, "Ultra Deep HPHT Completions: Classification, Design Methodologies and Technical Challenges, OTC 17927, Offshore Technology Conference, Houston, Tex., May. 2006; "HPHT Completion Challenges," SPE 97589, Society of Pet. Engrs., May, 2005).

Substances present in fluids produced from HPHT wells are often detrimental to materials that form tubulars and well completion equipment. One of the worst substances is hydrogen sulfide ($H_2S$), which can cause stress corrosion cracking, especially of materials that have high yield strength. Another substance that is often present in HPHT wells is carbon dioxide ($CO_2$), which can cause weight loss corrosion. The National Association of Corrosion Engineers (NACE) has developed guidelines for selecting materials that can be used in the presence of adverse wellbore chemistry. Most often these "NACE materials" fall in the mid-range of material hardness and yield strength.

Additionally, there is recognition among mechanical engineers that guidelines and practices for the safe design of equipment at 15,000 psi and 300° F. are vastly different for the requirements of 30,000 psi and 500° F. As an outgrowth of this knowledge, The American Petroleum Institute (API) is in the process of adopting the requirements of ASME Section VIII Division III into the design requirements of downhole equipment. Section VIII Division III practice requires that Ultra High Pressure Vessels have the allowable stress on materials de-rated as a result of temperature and that a fracture analysis be performed as a part of the design realization process. The simply stated result is that the wall thickness of pressure-containing devices must be very thick if homogeneous NACE materials are used in downhole pressure-containing vessels.

When drilling a well, costs are much higher as depth increases. A similar relationship exists with the diameter of the hole being drilled. Larger diameter, deeper holes become prohibitively expensive unless production flow area (inside diameter of the production tubing) is maximized. Operators want the largest possible flow area in the smallest possible hole. The economic viability of a project is determined by the flow rate from the well. For deep, expensive wells, the production flow area (diameter of the tubing) must often be 5½-in, 7-in, or in some cases 9⅝-in. The design of the well must have its genesis at the inside diameter of the production tubing and work outward to determine what diameter hole must be drilled.

These factors serve to work against each other in the following summarized manner. Wellbores must be deeper to reach pay zones. Production flow areas must be maximized and the hole diameter must be minimized for the well to be economic. The cost of drilling a well is much more expensive as the diameter and depth each increase. Materials must be tailored to the environment, but use of the strongest materials may be inadvisable or prohibited due to NACE requirements to avoid chemical attack. Design practices require thicker and thicker walls to accommodate these factors. Smaller drilled holes, bigger flowing bores, and thicker wall requirements are conflicting requirements.

What is needed is the development of a pressure-containing body that minimizes wall thickness, uses NACE materials where exposed to production fluids, fits in the smallest possible drilled and cased hole, and yields the largest possible flow area for the well. Use of such a body or device can significantly improve the economic viability of new wells.

SUMMARY OF THE INVENTION

Apparatus is provided for allowing greater flow area in wells by strengthening pressure-containing shells or tubulars that are a part of completion equipment in the wells. Laminate layers made of materials having higher yield value than equipment that comes in contact with well fluids are added to completion equipment. The layers may be formed of cylinders, wound wire or other forms of materials. Metal matrix composite materials may be used.

DETAILED DESCRIPTION

The description herein applies the invention primarily to a genre of well tools known as well completion tools or equipment. Generally, the invention applies to equipment in a well for which less wall thickness is needed. This would include: pressure-containing equipment in a well that must, because of its inherent design, have greater outside diameter than the tubing in a well if it is to maintain the same flow area as the tubing, and tubulars or connectors for tubulars that preferably are reduced in external diameter with the same internal diameter. This includes, but is not limited to, devices that are normally larger diameter than the tubing, such as subsurface safety valves, packers, flow control devices (e.g., sliding sleeves), tubing hangers, on-off attachments, and gas lift or instrument mandrels as well as equipment normally the same diameter as tubulars that would preferably be smaller in diameter, as least in some segments of a well, such as production tubing, liners, expansion joints and their connectors. One of ordinary skill in the art may immediately be able to apply this invention to other downhole devices, such as drilling equipment; any such uses of the present invention in wells is considered within the scope and spirit of the present invention.

Figure 1:
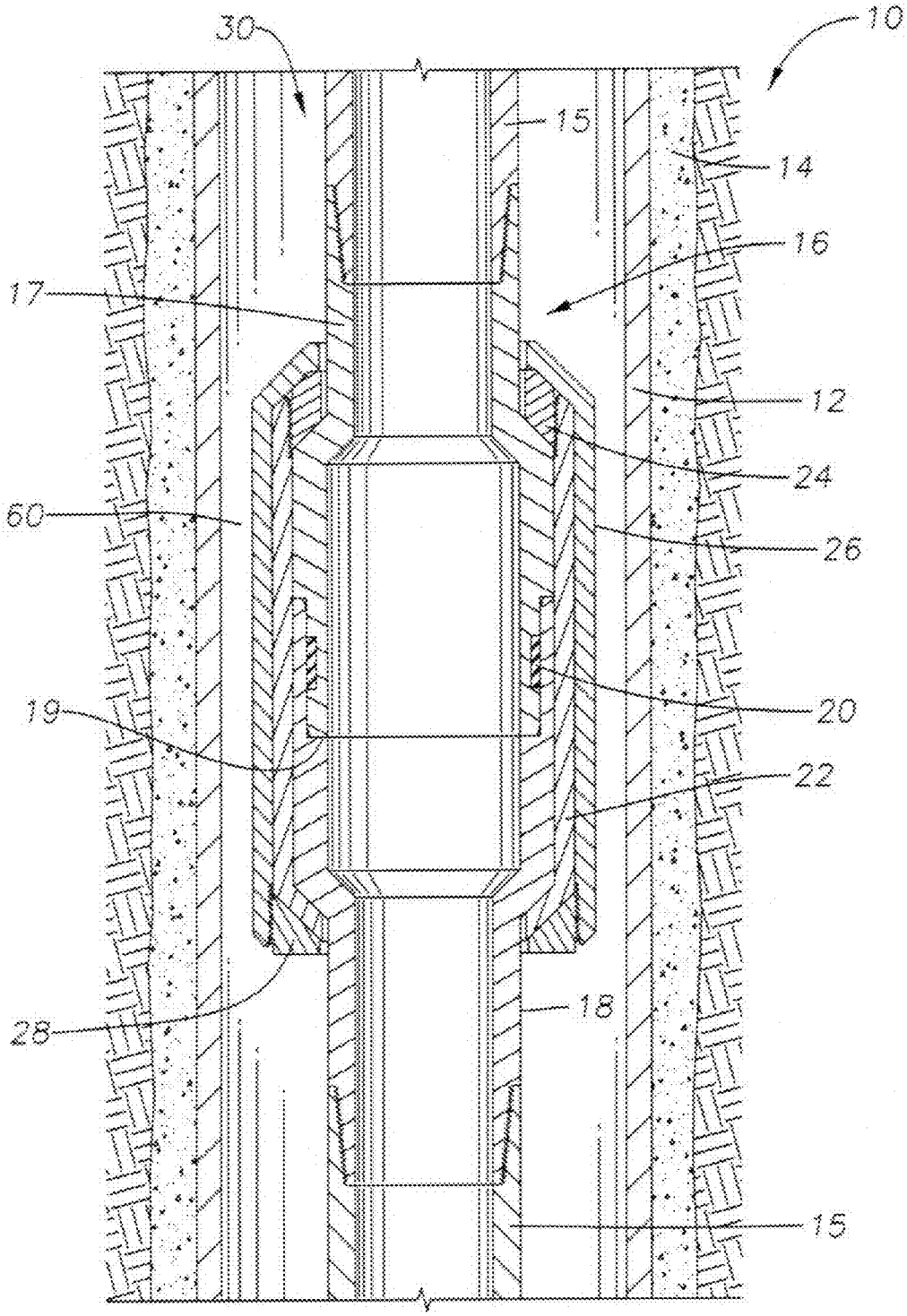
FIG. 1 is a cross-section view of a shell for completion equipment attached to tubing in a well showing one embodiment of laminate layers over the shell.

FIG. 1 illustrates the invention by showing a shell for completion equipment having a diameter greater than the diameter of tubing in a well. Well 10 has been drilled in the earth, casing 12 has been placed in the well and cement 14 has been placed in the annulus outside the casing. The diameter of the hole of well 10 has been selected to allow an acceptable thickness of cement 14 and outside diameter of casing 12. The wall thickness of casing 12 has been determined by the design burst and collapse strength of the casing and the inside diameter of casing 12 has been determined by the diameter of tubing 15 that is needed in the well and the size of any pressure-containing completion equipment that may be placed in the tubing. FIG. 1 simply shows sub 16, which generically represents the shell for completion equipment that must have a larger outside diameter than the diameter of tubing 15 while maintaining a larger inside diameter for containing completion equipment. Upper flow wetted body 17 connects to lower flow wetted body 18, forming joint 19 of sub 16. Pressure seal 20 is provided. This seal may be all-metal, elastomeric, thermoplastic, spring energized, in a concentric configuration (shown) or it may be a face seal (not shown). Upper body half 17 and lower body half 18 may be separated at joint 19 to allow inclusion of the functional portion of completion equipment. The present invention may be employed when no joint 19 is required (not shown), a single joint 19 is required, or when a plurality of joints is required. Joint 19 may contain threads for connecting or be joined by welding, for examples.

After assembly of sub 16, first sleeve 22 is arranged to slide over and cover the larger outside diameter of sub 16. First sleeve 22 may be cold-worked in place. Depending on the service requirements, a preferred embodiment is pressed fit, whereby the outside diameters of upper flow wetted body 17 and lower flow wetted body 18 are larger than the inside diameter of first sleeve 22 and may be tapered. In this instance, first sleeve 22 is placed under a large axial load, which causes it to deform radially outward and expand over the larger outside diameters of upper flow wetted body 17 and lower flow wetted body 18. In an alternative procedure, first sleeve 22 is heated to cause expansion and placed over bodies 16 and 17 while hot. First sleeve 22 then acts as an elastic band, placing compressive stress on the upper flow wetted body 17 and the lower flow wetted body 18. First sleeve 22 may be a higher yield strength non-NACE material, or a material with a higher elastic modulus, such as titanium. The net effect is a higher burst pressure for the laminate body than it would be if the wall thickness were a homogenous NACE material. Sufficient internal pressure exerted inside the well tool places upper flow wetted body 17 and lower flow wetted body 18 in tension in the radial direction, which is counteracted by the compressive forces exerted by first sleeve 22. First nut 24 may be threaded onto first sleeve 22 to retain it. In this configuration, tubing tensile forces are borne by first nut 24, but if upper flow wetted body 17 and lower flow wetted body 18 are threaded together, tubing tensile forces would be primarily borne there. The additional laminate layers, if confined in the axial direction so as to assume an axial load, are intended to increase the axial strength within the tensile limits of the outer layers. If ceramic or other high-strength fibers are used in additional layers, this increase could be significant.

In the transitional section where flow area is changing, wall thickness of bodies 17 and 18 may be adjusted in response to stress analysis, which may be performed using well-known finite element procedures, and which may include the effect of outer laminate layers. Such analyses may be substantiated by well-known techniques using strain gauges.

Second sleeve 26 (or subsequent sleeves), having second nut 28, may also be used to further strengthen the assembly by adding laminate layers, each with its own beneficial material properties.

First sleeve 22 may be a series of rings arranged longitudinally along the body that would yield the same effect on burst strength of the body. Additionally, the first sleeve may take the form of a helix or helical strip wrapped around upper flow wetted body 17 and lower flow wetted body 18. These and other uses of the lamination effect by one of normal skill in the art should be considered within the scope and spirit of the present invention.

In operation, the composite wall thickness of upper flow wetted body 17 and lower flow wetted body 18, first sleeve 22 and second sleeve 26 or any subsequent sleeves is thinner than if the design engineer chose a homogenous commercially available NACE material. This allows a greater flow area in any given well (or casing) size.

Figure 2:
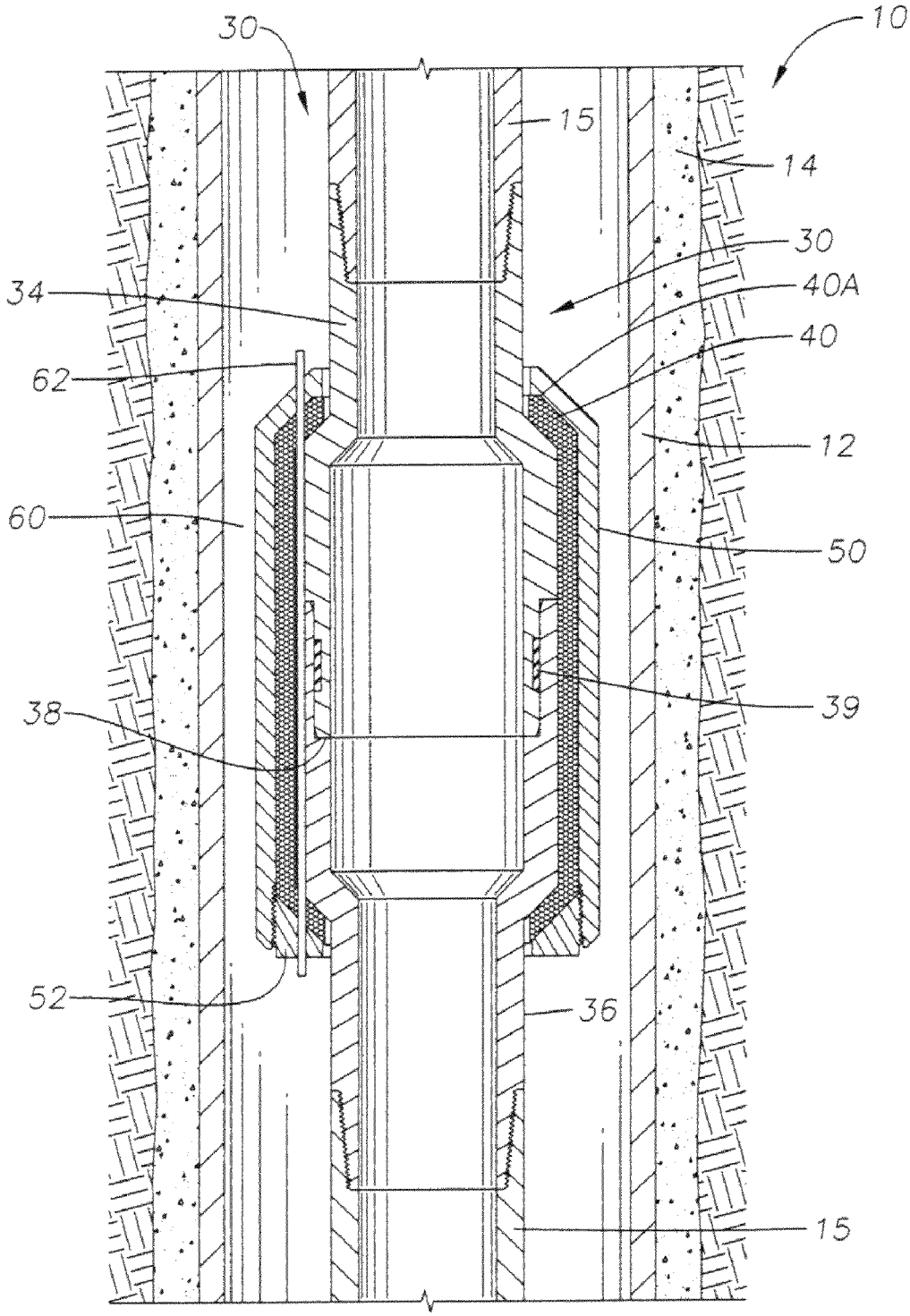
FIG. 2 is a cross-section view of a shell for completion equipment attached to tubing in a well showing another embodiment of laminate layers over the shell and a feed-through tube in the laminate layers.

FIG. 2 depicts an alternate embodiment of the invention disclosed herein. Sub 30 is attached on both upper and lower ends to production tubing 15. Sub 30 includes larger internal diameter for completion equipment, as described and shown in FIG. 1. Upper flow wetted body 34 connects to a lower flow wetted body 36, forming joint 38. Pressure is contained by seal 39. This seal may be all-metal, elastomeric, thermoplastic, spring energized, in a concentric configuration (shown) or it may be a face seal (not shown). Upper and lower body halves are depicted, so as to facilitate or incorporate the inclusion of the functional portion of completion equipment, be it a packer, subsurface safety valve, or other equipment. The present invention may be employed when no joint 38 is required (not shown), a single joint 38 is required, or if a plurality of joints such as joint 38 are required.

After assembly of sub 30, wire wraps 40 may be wound over sub 30. Depicted in FIG. 2 is round wire, but square wire may also be used, and in many instances, may be preferable. Wire may have much higher yield strength than wrought material. Higher strength material alone adds to the allowable stress the body could withstand. There is another significant advantage to the use of wire. The wire may be wrapped under tension, preferably at a tension that is close to the yield strength of the wire. Multiple wraps of wire around the upper and lower body halves of sub 30 may put a very high compressive force on sub 30. Sufficient internal pressure exerted inside the well tool may place upper flow wetted body 34 and lower flow wetted body 36 in tension in the circumferential direction, which is counteracted by the compressive forces exerted by the first sleeve. In another embodiment, a composite material may be formed. A metal matrix composite may be utilized to greatly increase burst resistance of relatively thin shells. Composite may be formed of a ceramic fiber or monofilament that is first wound over the flow wetted body to have a structure as shown in FIG. 2, where the fiber is now illustrated at 40. Molten metal 40A may then be injected into a mold to form a metal matrix over the ceramic fiber. This procedure can result in a composite material that is many times stronger than the NACE-approved material of the flow wetted body. The assembly can then be post-cast heat treated to return the body to NACE specifications. Ceramic fiber is available from 3M Company of St. Paul, Minn. and other sources, These embodiments mean that a very high internal pressure may be applied to counteract the "pre-loaded" collapse force induced by the wire (or ceramic) wraps, to take the body to a neutrally stressed state. The result is a much higher internal pressure (or burst pressure) can be born by the well apparatus of the present invention before permanent deformation or failure due to overstress.

Second sleeve 50 (FIG. 2) (or subsequent sleeves) may also be used to further strengthen the assembly by adding laminated layers, each with its own beneficial material properties. Second nut 52 may be threaded into second sleeve 50 to retain it. In this configuration, tubing tensile forces may be borne by second nut 52, but if upper flow wetted body 34 and lower flow wetted body 36 are threaded together, tubing tensile forces would be primarily borne there.

The shell that encloses well completion equipment normally has a larger diameter than the tubing that conveys it into the well. FIG. 1 and FIG. 2 show this relationship. Annulus 60 is formed outside the shell of completion equipment and any laminate layers on the shell and inside the casing. Often in multilateral wells umbilicals or control lines (not shown) need to pass through annulus 60. As wall thickness requirements increase with pressure and temperature, annulus 60 may become too small for well umbilicals or control lines to pass, even with a laminate structure as disclosed herein. In another embodiment (FIG. 2), wherein a hollow cylinder or multiple wraps of wire or fiber are used, small diameter "feed through" tubing 62 may be adapted to the assembly and placed in a rounded groove in sub 30 or placed adjacent sub 30 prior to beginning the wrapping operation. This would allow feed through 62 to be directed through the body with minimal effect on the pressure-retaining properties of the apparatus.

Figure 3:
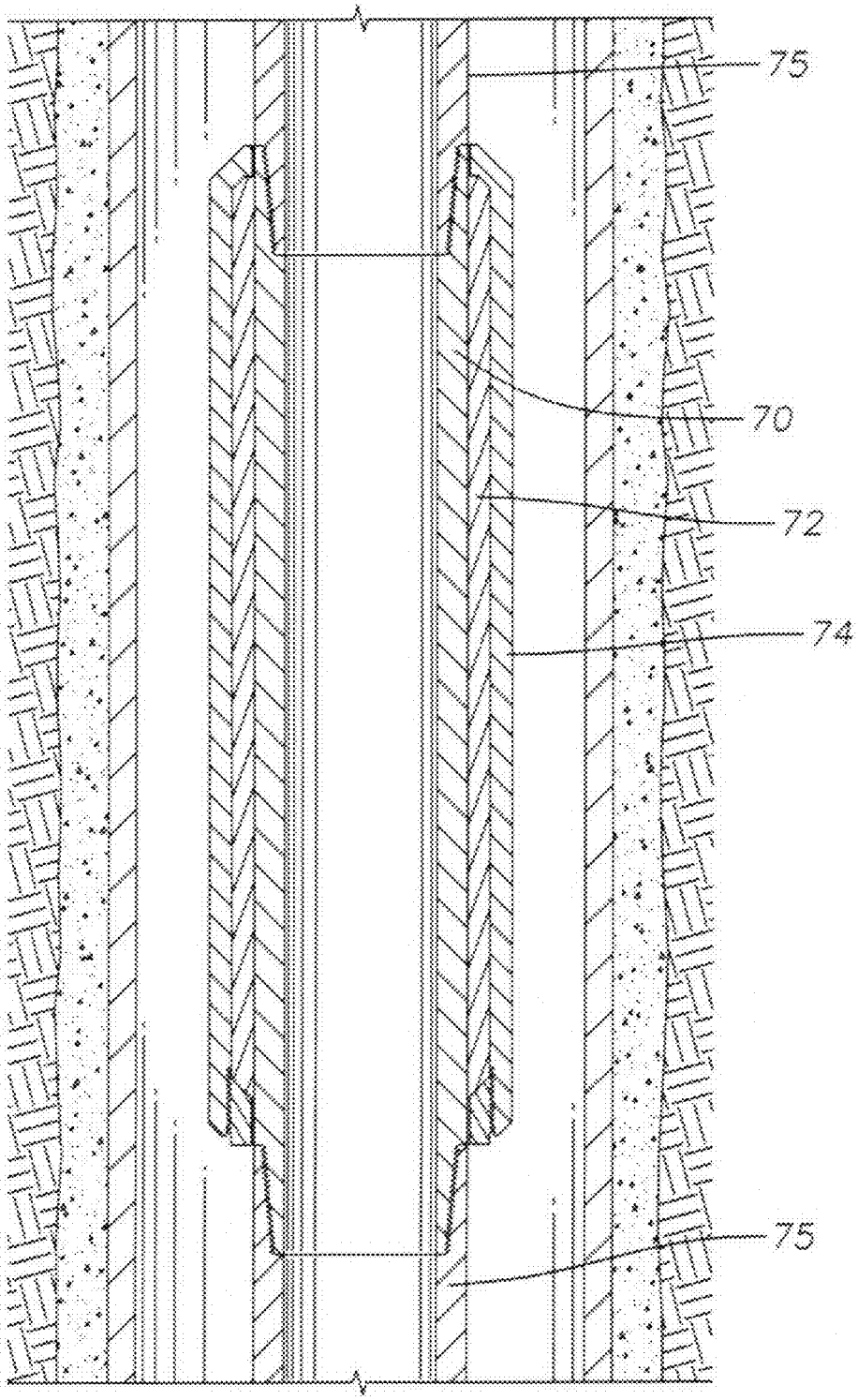
FIG. 3 is a cross-section view of a tubular for completion equipment showing an embodiment of laminate layers over the tubular.

When smaller outside diameter of a tubular or a connector for a tubular is needed without decreasing inside diameter, the methods described above may be employed. FIG. 3 illustrates the application of first laminate layer 72 and second laminate layer 74 to tubular 70, which is illustrated with threads for connecting to well tubing 75. Tubular 70 may be production tubing, a liner, an expansion joint and the connectors for any of these, for example. Various laminate layers as described above may be similarly applied to tubular 70 or to a connector for tubular 70. A feed-through tube such as shown in FIG. 2 may be included in a groove in tubular 70 and under first laminate layer 72.

Although the present invention has been described with reference to specific details, it is not intended that such details should be regarded as limitations on the scope of the invention, except as and to the extent that they are included in the accompanying claims.

What we claim is:

1. A pressure-containing apparatus for a well, comprising:

a shell adapted to be connected to a well tubing and adapted to enclose well completion equipment and having a bore there through, the shell being formed of a material having a yield strength; and a first laminate layer contacting an outside surface of the shell, the first laminate layer being formed of a material having higher yield strength than the yield strength of the material forming the shell, so as to increase the pressure-containing ability of the shell, the first laminate layer formed so as to exert compressive forces to the shell prior to any pressure being applied within the shell, whereby when internal pressure is applied within the shell, the radial forces acting within the shell are counteracted by the compressive forces exerted on the exterior of the shell by the first laminate layer.

2. The pressure-containing apparatus of claim 1 further comprising a second laminate layer contacting an outside surface of the first laminate layer to further increase the pressure-containing ability of the shell.

3. The pressure-containing apparatus of claim 2 wherein the second laminate layer comprises a cylinder.

4. The pressure-containing apparatus of claim 2 wherein the second laminate layer comprises a row of wire wound outside the first laminate layer.

5. The pressure-containing apparatus of claim 2 wherein the first or the second laminate layer comprises a metal matrix composite.

6. The pressure-containing apparatus of claim 1 wherein the first laminate layer comprises a cylinder or a row of wire wound over the shell.

7. The pressure-containing apparatus of claim 1 wherein the material of the first laminate layer comprises a metal matrix composite.

8. The pressure-containing apparatus of claim 1 wherein the shell includes a section having a transition in flow area therein and the section includes an area of increased wall thickness in the shell.

9. The pressure-containing apparatus of claim 1 wherein the laminate layer further comprises a nut to provide an axial force from the laminate layer when the shell is subjected to an axial tension force.

10. The pressure-containing apparatus of claim 1 wherein the shell is adapted to enclose well completion equipment selected from equipment consisting of a subsurface safety valve, a mandrel of a packer, a device for controlling flow in the wellbore, a sliding sleeve, a tubing hanger, an on-off attachment, a gas lift mandrel or an instrument mandrel.

11. The pressure-containing apparatus of claim 1 wherein the outside diameter of the shell is greater than the inside diameter of the first laminate layer prior to assembly and the first laminate layer is placed under axial compression to fit over the shell.

12. The pressure containing apparatus of claim 1 wherein the first laminate layer is heated to cause expansion and then placed over the shell while hot, whereby upon cooling the first laminate layer exerts compressive forces on the shell.

13. The pressure containing apparatus of claim 1 wherein the first laminate layer is wound under tension about the shell.

* * * * *